US007758175B2

(12) United States Patent
Amano et al.

(10) Patent No.: US 7,758,175 B2
(45) Date of Patent: Jul. 20, 2010

(54) INK CARTRIDGE AND PRINTER

(75) Inventors: Kazuhiko Amano, Tokyo-to (JP); Naoyuki Toyoda, Suwa (JP); Hiroyuki Hara, Chino (JP); Takayuki Kondo, Suwa (JP)

(73) Assignee: Seiko Epson Corporation, tokyo (JP)

( * ) Notice: Subject to any disclaimer, the term of this patent is extended or adjusted under 35 U.S.C. 154(b) by 706 days.

(21) Appl. No.: 11/750,152

(22) Filed: May 17, 2007

(65) Prior Publication Data

US 2007/0268347 A1 Nov. 22, 2007

(30) Foreign Application Priority Data

May 19, 2006 (JP) ..... 2006-140803
Apr. 10, 2007 (JP) ..... 2007-103186

(51) Int. Cl.
*B41J 2/175* (2006.01)

(52) U.S. Cl. ..... 347/86

(58) Field of Classification Search ..... 347/5, 347/7, 19, 49, 85, 86, 87
See application file for complete search history.

(56) References Cited

U.S. PATENT DOCUMENTS 6,155,678 A * 12/2000 Komplin et al. ..... 347/86
6,302,535 B1 * 10/2001 Sturgeon et al. ..... 347/86
6,848,776 B2 * 2/2005 Nishioka et al. ..... 347/86
7,445,322 B2 * 11/2008 Kitabatake et al. ..... 347/86
7,513,613 B2 * 4/2009 Ishizawa et al. ..... 347/86
7,625,077 B2 * 12/2009 Shinada et al. ..... 347/84

FOREIGN PATENT DOCUMENTS

JP A 2005-313449 11/2005
WO WO 01/54910 A2 8/2001

* cited by examiner

*Primary Examiner*—Anh T. N. Vo
(74) *Attorney, Agent, or Firm*—Oliff & Berridge, PLC

(57) ABSTRACT

An ink cartridge that is filled with ink and, used with the ink cartridge loaded into a printer includes a reservoir that reserves the ink, an outlet through which the ink is supplied to the printer with the ink cartridge loaded, at least one ink supply system that includes a channel that leads the ink from the reservoir to the outlet, and a sensor that detects whether the channel is filled with the ink or gas, an ink cartridge terminal that is electrically coupled to the sensor and makes contact with a printer terminal disposed on the printer upon loading of the ink cartridge. A detection region of the channel where detection is carried out by the sensor is previously filled with gas with the ink cartridge yet to be used. Whether or not the use of the ink cartridge is proper is determined based on information from the sensor.

23 Claims, 10 Drawing Sheets

INK CARTRIDGE AND PRINTER

TECHNICAL FIELD

Several aspects of the present invention relates to an ink cartridge and a printer.

RELATED ART

A printer for printing on a recording medium (e.g., paper surface) includes a carriage into which an ink cartridge is loaded and a droplet discharging head (recording head) to which ink is supplied from the ink cartridge loaded into the carriage. The droplet discharging head discharges the supplied ink in the form of droplets toward a surface of the recording medium.

Known as an ink cartridge to be loaded into such a printer is, for example, the ink cartridge described in International Publication Pamphlet No. 01/54910. This related-art ink cartridge has an outlet through which ink is supplied to a printer with the ink cartridge loaded.

However, there has been a possibility that when the related-art ink cartridge runs out of ink, this used ink cartridge may be refilled with another type of ink (fraudulent ink) whose quality is not guaranteed by the manufacturer of the original ink cartridge. Such ink cartridges filled with fraudulent ink have been reused by a third party, that is, those have been loaded into a printer to carry out printing.

Reusing ink cartridges in this manner has caused problems, such as clogging of the droplet discharging head nozzle with ink, resulting in failure of ink discharging from the nozzle, or deterioration of the condition of printing performed on a recording medium.

SUMMARY

An advantage of aspects of the invention is to provide an ink cartridge and a printer that, for example, each prevents a used ink cartridge from being reused fraudulently due to injection of fraudulent ink into the ink cartridge.

According to a first aspect of the invention, an ink cartridge that is filled with ink and used with the ink cartridge loaded into a printer includes a reservoir that reserves the ink, an outlet through which the ink is supplied to the printer with the ink cartridge loaded, at least one ink supply system that includes a channel that leads the ink from the reservoir to the outlet, and a sensor that detects whether the channel is filled with the ink or gas, an ink cartridge terminal that is electrically coupled to the sensor and makes contact with a printer terminal disposed on the printer upon loading of the ink cartridge. A detection region of the channel where detection is carried out by the sensor is previously filled with gas with the ink cartridge yet to be used. Whether or not the use of the ink cartridge is proper is determined based on information from the sensor.

As a result, it is possible, for example, to prevent a used ink cartridge from being reused due to injection of nonconforming ink into the used ink cartridge. Moreover, it is possible, for example, to identify the type of ink that is difficult to identify visually, according to a necessary property.

In the ink cartridge according to the first aspect of the invention, the sensor preferably includes a light emitter that emits light toward the channel and a light receiver that is disposed so as to be opposed to the light emitter with the channel therebetween and receives light emitted from the light emitter and transmitted through or reflected from the channel.

As a result, it is reliably determined whether or not the use of the ink cartridge is proper.

In the ink cartridge according to the first aspect of the invention, a light path between the light emitter and light receiver is preferably along a longitudinal direction of the channel.

As a result, it is reliably determined whether or not the use of the ink cartridge is proper.

In the ink cartridge according to the first aspect of the invention, in order to be distinguished from other types of ink having an identical color, the ink is preferably infrared absorbing material-added ink, and the light emitted by the light emitter is preferably infrared radiation.

As a result, it is reliably determined whether or not the use of the ink cartridge is proper.

In the ink cartridge according to the first aspect of the invention, a peak wavelength of infrared radiation emitted by the light emitter is preferably 750 to 1500 nm.

As a result, the infrared radiation is surely absorbed by the infrared absorbing material mixed into the ink.

In the ink cartridge according to the first aspect of the invention, the infrared absorbing material is preferably made principally of at least one of a phthalocyanine coloring matter, a naphthalocyanine coloring matter, and an anthraquinone coloring matter.

As a result, the infrared radiation is surely absorbed.

In the ink cartridge according to the first aspect of the invention, the channel is preferably bent at at least one point between both ends of the channel.

As a result, the ink inside the ink cartridge can be exhausted.

In the ink cartridge according to the first aspect of the invention, the outlet preferably opens downward with the ink cartridge loaded, and the channel preferably includes a first horizontal path extending approximately horizontally from a bottom of the reservoir, a first vertical path extending approximately vertically upward from an end of the first horizontal path, a second horizontal path extending approximately horizontally from an upper end of the first vertical path, and a second vertical path extending approximately vertically downward from an end of the second horizontal path and reaching the outlet.

As a result, the ink inside the ink cartridge can be exhausted.

In the ink cartridge according to the first aspect of the invention, the detection region is preferably the second horizontal path.

As a result, it is reliably detected whether the detection region is filled with the ink or air.

In the ink cartridge according to the first aspect of the invention, the gas with which the channel is filled is preferably air.

As a result, whether the channel is filled with the ink or air is reliably detected.

According to a second aspect of the invention, a printer that carries out printing with the ink cartridge loaded, the ink cartridge being according to the first aspect of the invention, includes a carriage into which the ink cartridge is loaded and that includes a printer terminal that makes contact with a terminal of the ink cartridge upon loading of the ink cartridge, a droplet discharging head that discharges ink supplied from the loaded ink cartridge in the form of a droplet, and a controller that is electrically coupled to the printer terminal and controls a droplet discharging operation of the droplet discharging head. If printing is carried out for a first time using the ink cartridge that is yet to be used, the controller determines whether the channel is filled with the ink or gas based on information from the sensor included in the ink cartridge. If the channel is filled with the ink, the controller prohibits a printing operation.

As a result, it is possible to prevent a used ink cartridge from being reused fraudulently due to injection of fraudulent ink into the used ink cartridge.

According to a third aspect of the invention, a printer that carries out printing with an ink cartridge loaded, the ink cartridge being filled with ink and including a channel through which the ink passes, the channel being previously filled with gas with the ink cartridge yet to be used, includes a carriage into which the ink cartridge is loaded and that includes a printer terminal that makes contact with a terminal of the ink cartridge upon loading of the ink cartridge, a sensor that detects whether the channel is filled with the ink or gas with the ink cartridge loaded, a droplet discharging head that discharges the ink supplied from the loaded ink cartridge in the form of a droplet, and a controller that is electrically coupled to the printer terminal and controls a droplet discharging operation of the droplet discharging head. If printing is carried out for a first time using the ink cartridge that is vet to be used, the controller determines whether the channel is filled with the ink or gas based on information from the sensor included in the ink cartridge. If the channel is filled with the ink, the controller prohibits a printing operation.

As a result, it is possible to prevent a used ink cartridge from being reused fraudulently due to injection of fraudulent ink into the used ink cartridge.

In the printer according to the second aspect of the invention, the sensor preferably includes a light emitter that emits light toward the channel and a light receiver that is disposed so as to be opposed to the light emitter with the channel therebetween and receives light emitted from the light emitter and transmitted through or reflected from the channel.

As a result, it is reliably determined whether the channel is filled with the ink or gas.

In the printer according to the second aspect of the invention, the controller preferably determines whether the channel is filled with the ink or gas according to an amount of infrared radiation received by the light receiver.

As a result, it is possible to prevent a used ink cartridge from being reused fraudulently due to injection of fraudulent ink into the used ink cartridge.

In the printer according to the second aspect of the invention, the controller preferably performs control such that if the amount is less than a predetermined value, the printing operation is prohibited.

As a result, it is possible to prevent a used ink cartridge from being reused fraudulently due to injection of fraudulent ink into the used ink cartridge.

In the printer according to the second aspect of the invention, the controller preferably performs control such that if the amount is equal to or more than the predetermined value, the printing operation is carried out.

As a result, it is possible to prevent a used ink cartridge from being reused fraudulently due to injection of fraudulent ink into the used ink cartridge.

In the printer according to the second aspect of the invention, the controller preferably performs control such that if the ink cartridge is unloaded from and then reloaded into the carriage before the loaded ink cartridge becomes empty, the printing operation is carried out again.

As a result, printing is carried out even if the ink cartridge in use is unloaded and then reloaded.

In the printer according to the second aspect of the invention, if the amount reaches the predetermined value, the controller preferably counts a number of print dots.

As a result, the ink can surely be exhausted.

In the printer according to the second aspect of the invention, if the counted number of print dots reaches a predetermined number of dots, the controller preferably performs control such that the printing operation is stopped.

As a result, the ink can surely be exhausted.

The printer according to the second aspect of the invention preferably further includes a display that indicates that the ink cartridge should be replaced, if the printing operation is prohibited.

As a result, the need for replacement of the ink cartridge or replacement timing can be recognized.

In the printer according to the second aspect of the invention, in order to be distinguished from other types of ink having an identical color, the ink is preferably infrared absorbing material-added ink, and the light emitted by the light emitter is preferably infrared radiation.

As a result, it is reliably determined whether the channel is filled with ink or gas.

In the printer according to the second aspect of the invention, a peak wavelength of infrared radiation emitted by the light emitter is 750 to 1500 nm.

As a result, the infrared radiation can surely be absorbed by the infrared absorbing material mixed into the ink.

In the printer according to the second aspect of the invention, the infrared absorbing material is preferably made principally of at least one of a phthalocyanine coloring matter, a naphthalocyanine coloring matter, and an anthraquinone coloring matter.

As a result, the infrared radiation can surely be absorbed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Ink cartridges and printers according to exemplary embodiments of the invention will now be described in detail with reference to the accompanying drawings.

First Embodiment

Figure 1:
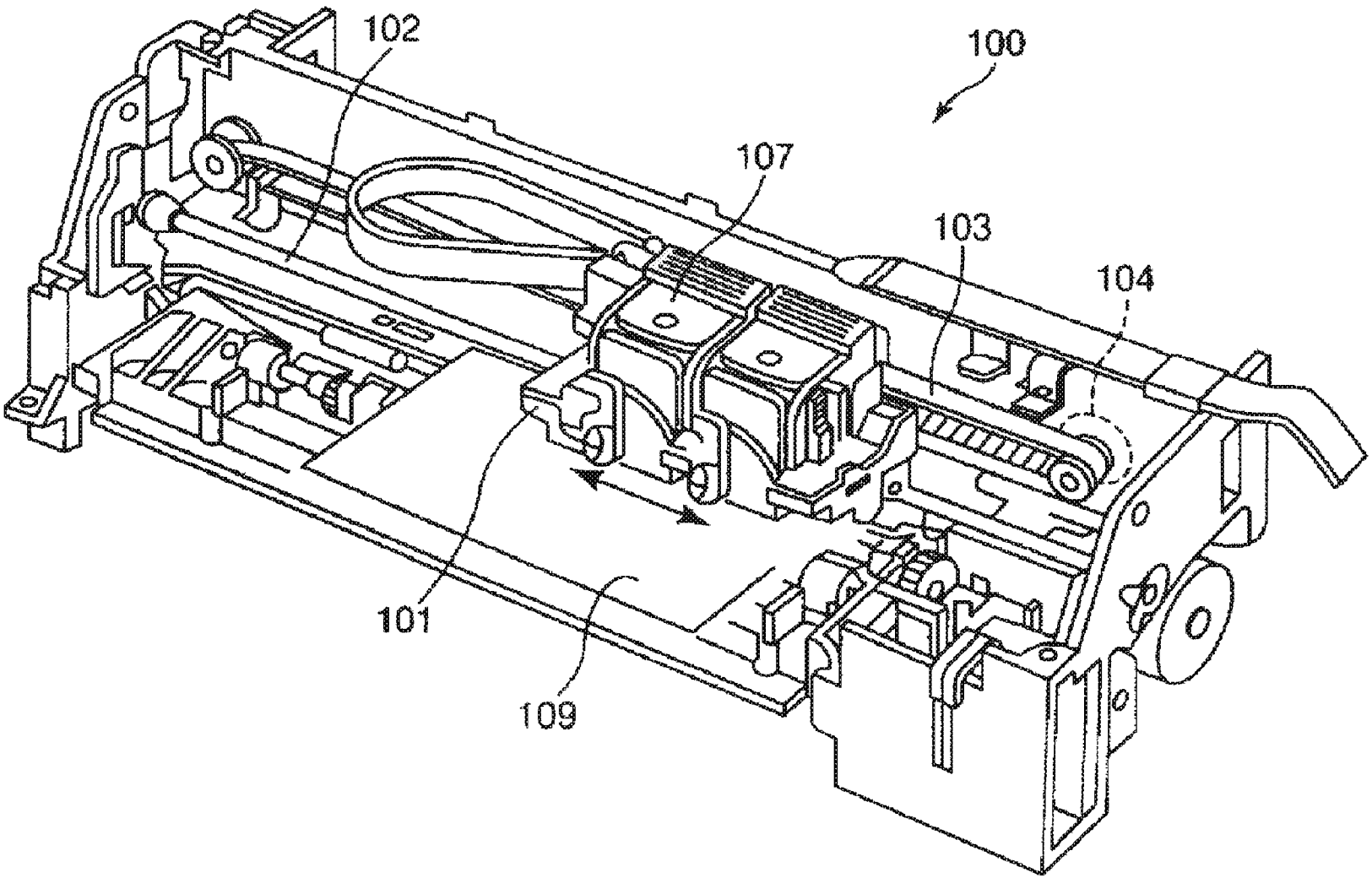
FIG. 1 is an oblique perspective view showing a printer according to a first embodiment of the invention.
Figure 2A:
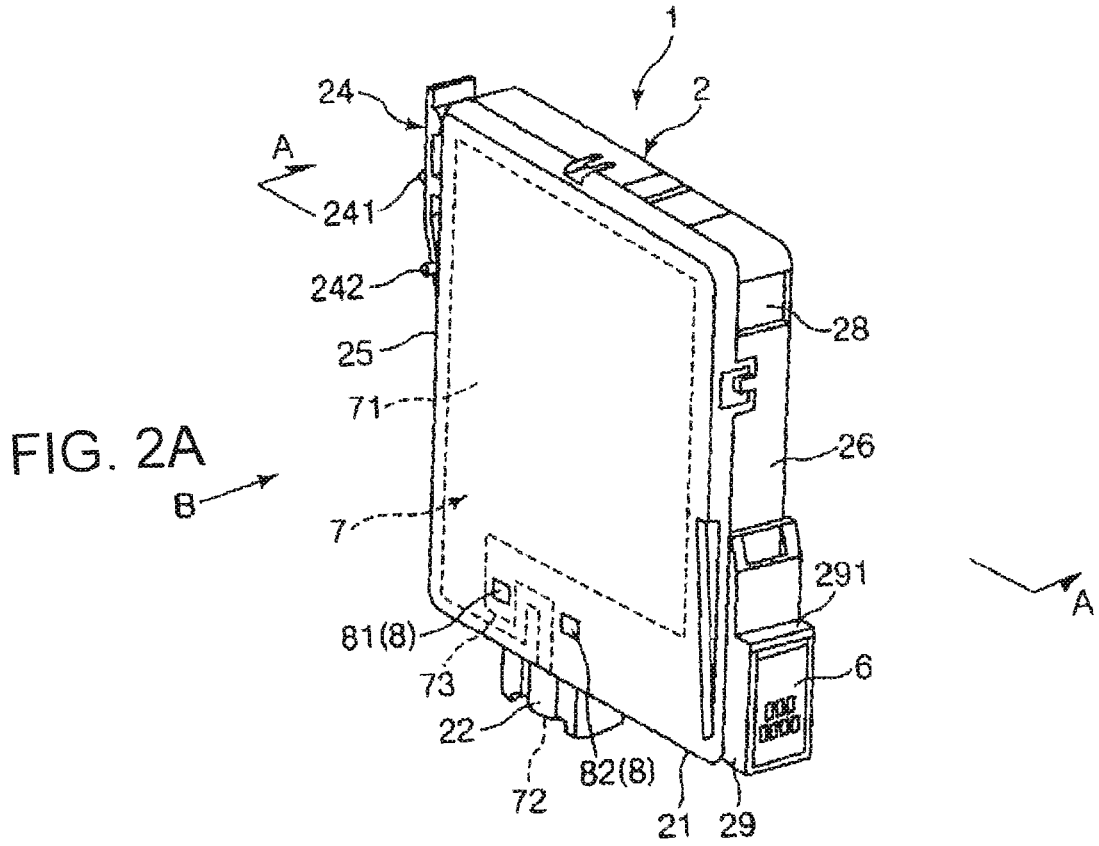
FIGS. 2A and 2B are oblique perspective views showing an ink cartridge according to the first embodiment of the invention to be loaded into the printer shown in FIG. 1.
Figure 2B:
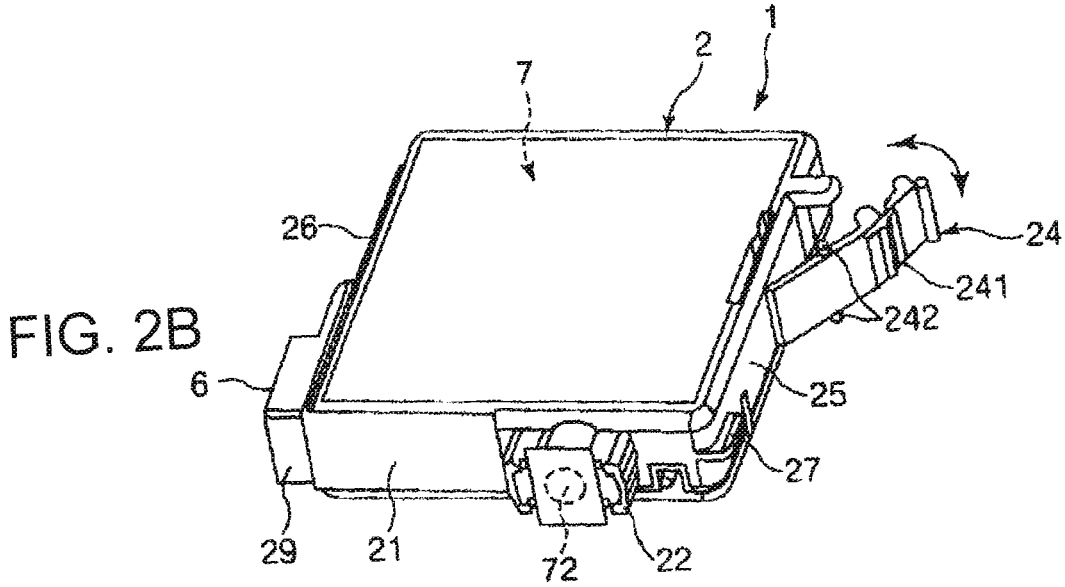
Figure 3:
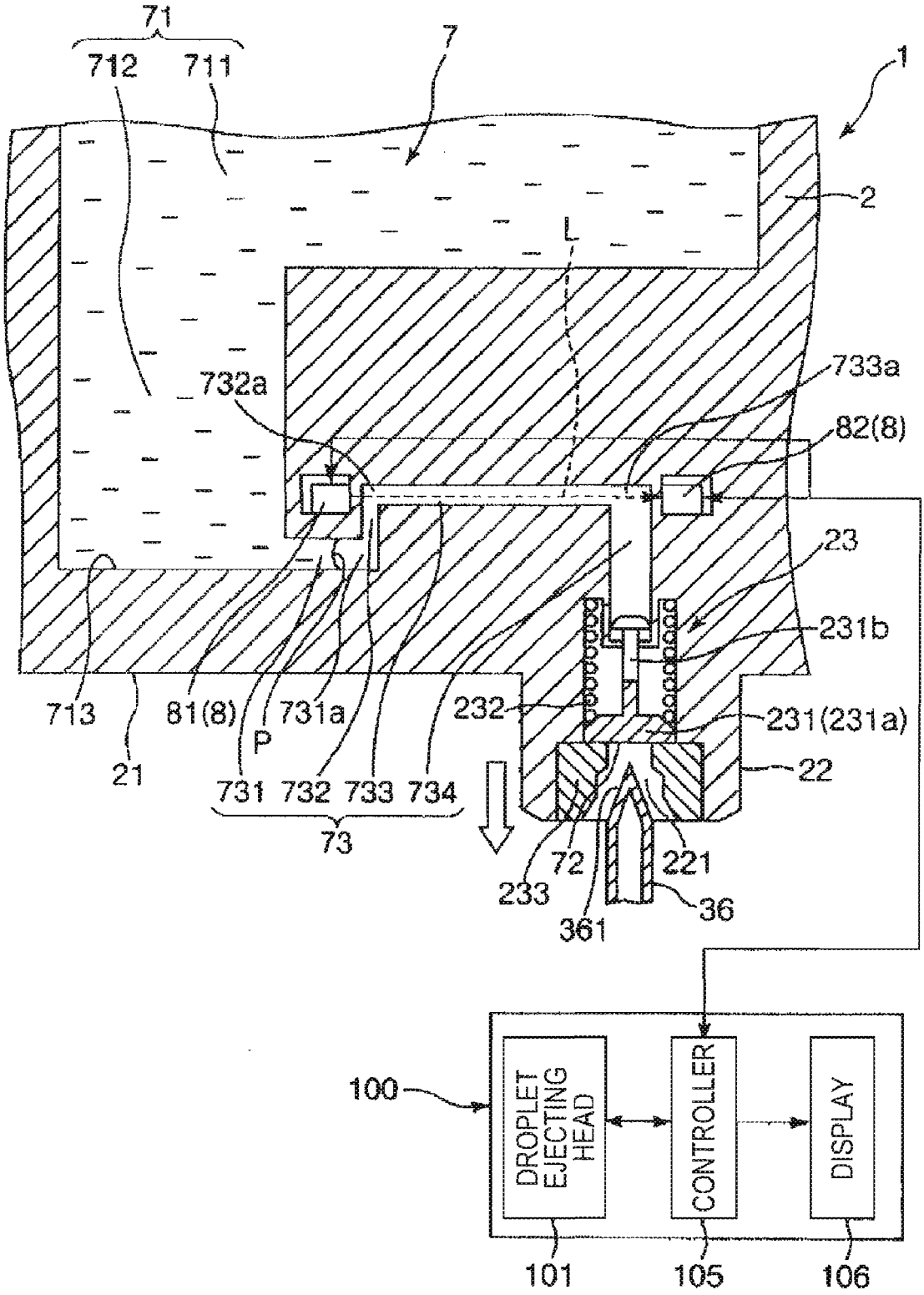
FIG. 3 is a sectional view taken along line A-A of FIG. 2A.
Figure 4A:
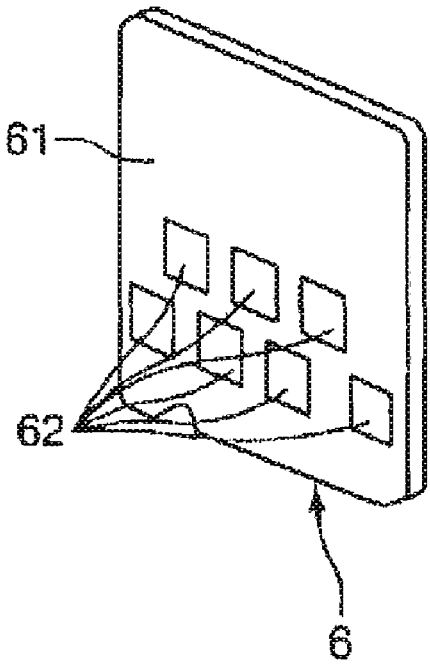
FIGS. 4A and 4B are oblique perspective views showing a terminal included in the ink cartridge shown in FIGS. 2A and 2B.
Figure 4B:
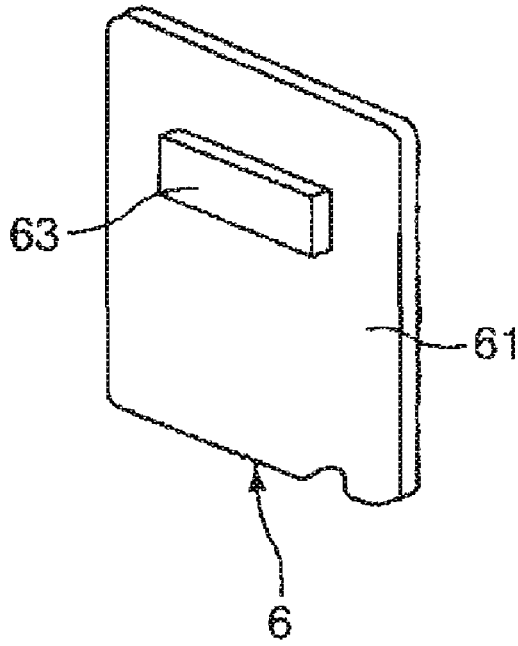
Figure 5:
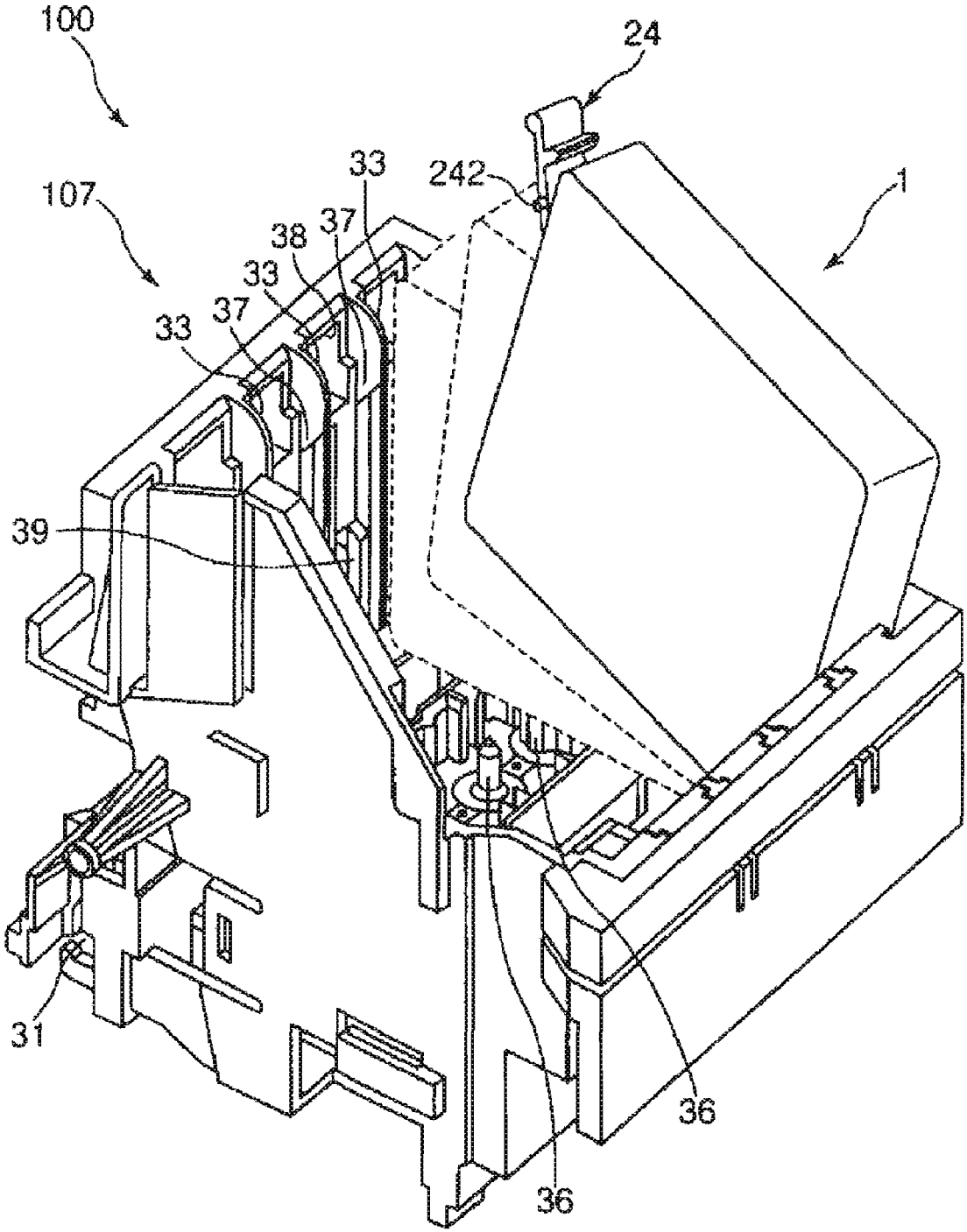
FIG. 5 is an oblique perspective view showing a droplet discharging head included in the printer shown in FIG. 1.
Figure 6:
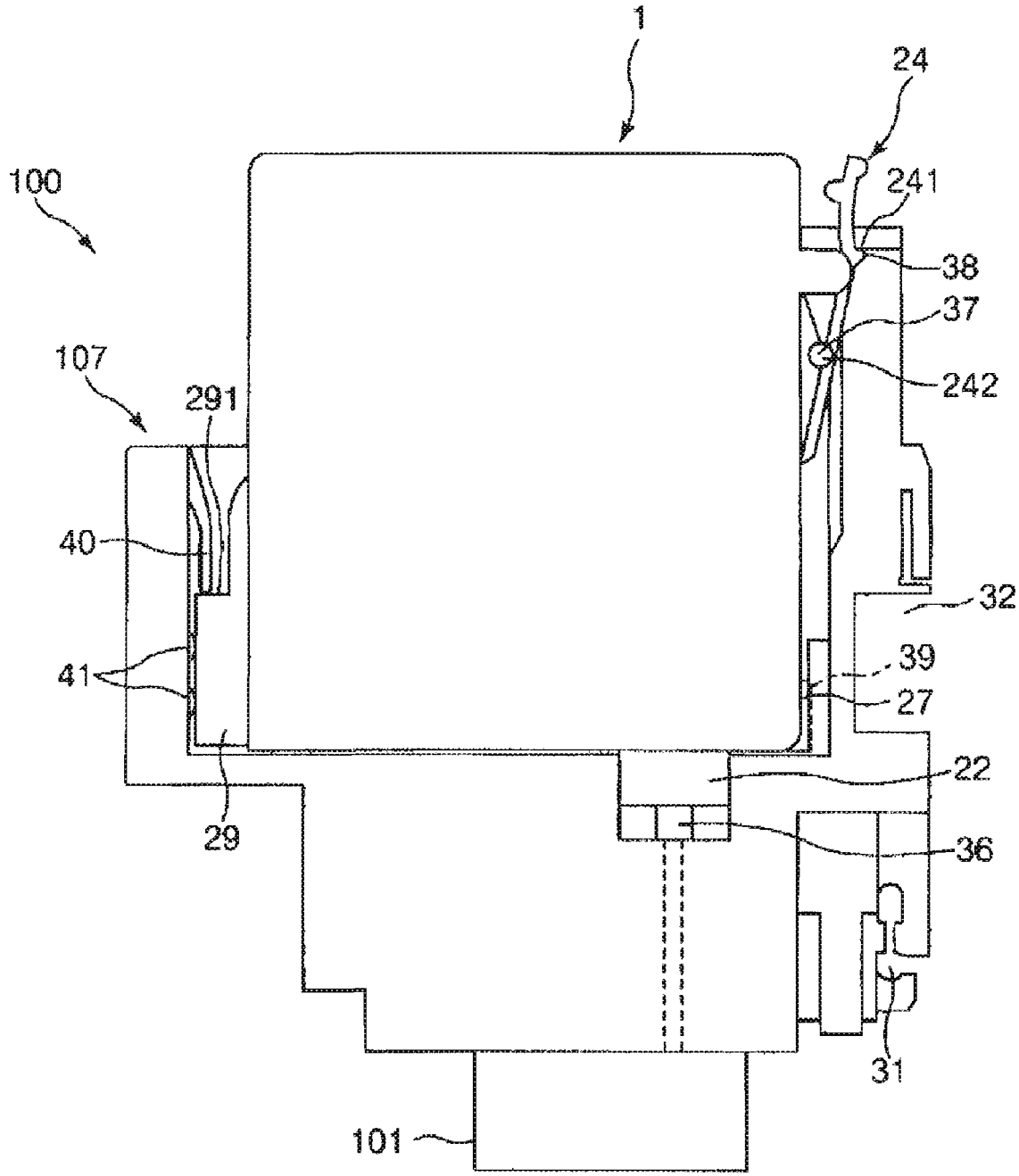
FIG. 6 is a side view of the droplet discharging head shown in FIG. 5.
Figure 7:
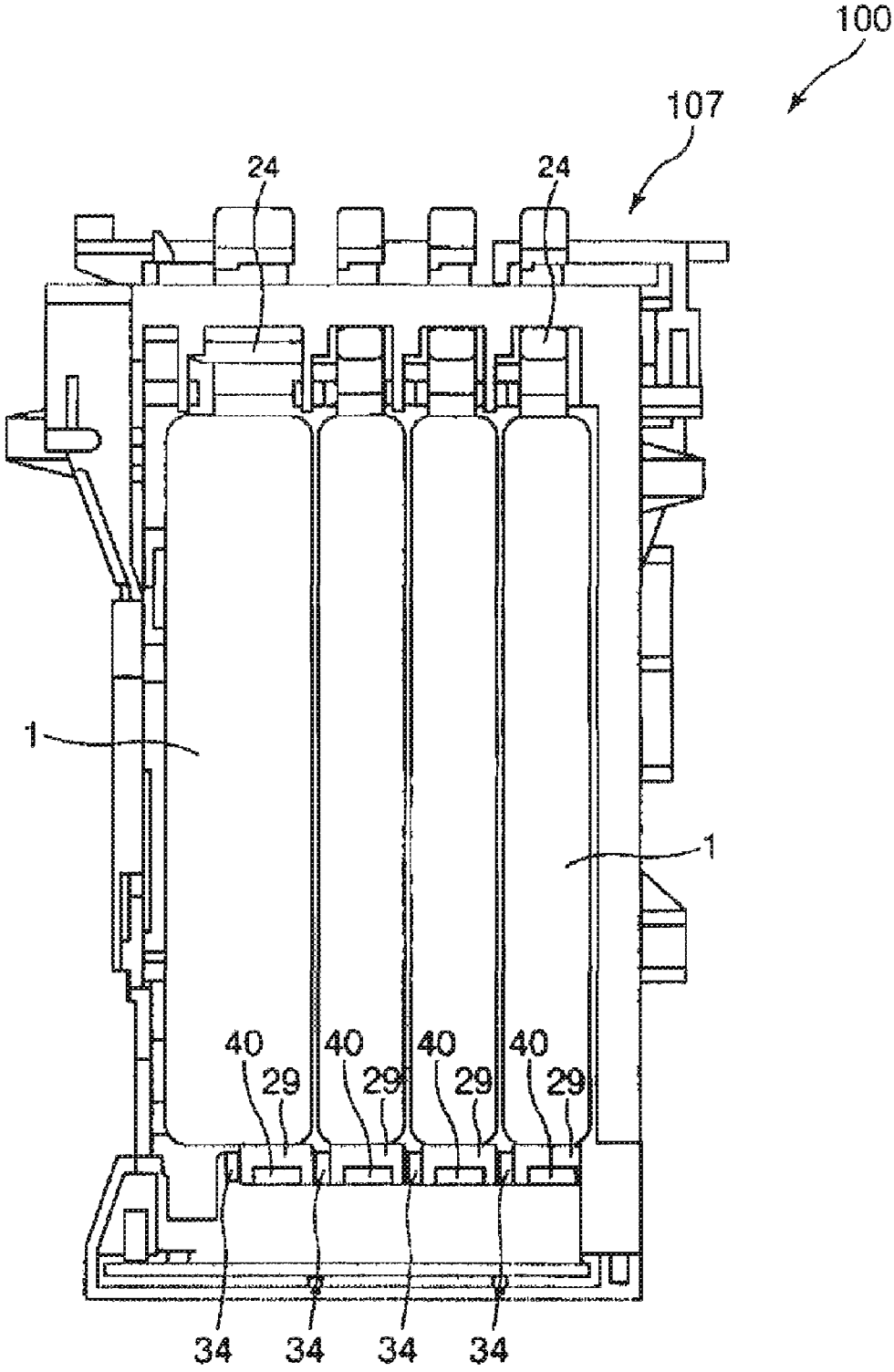
FIG. 7 is a plan view of the droplet discharging head shown in FIG. 5.
Figure 8:
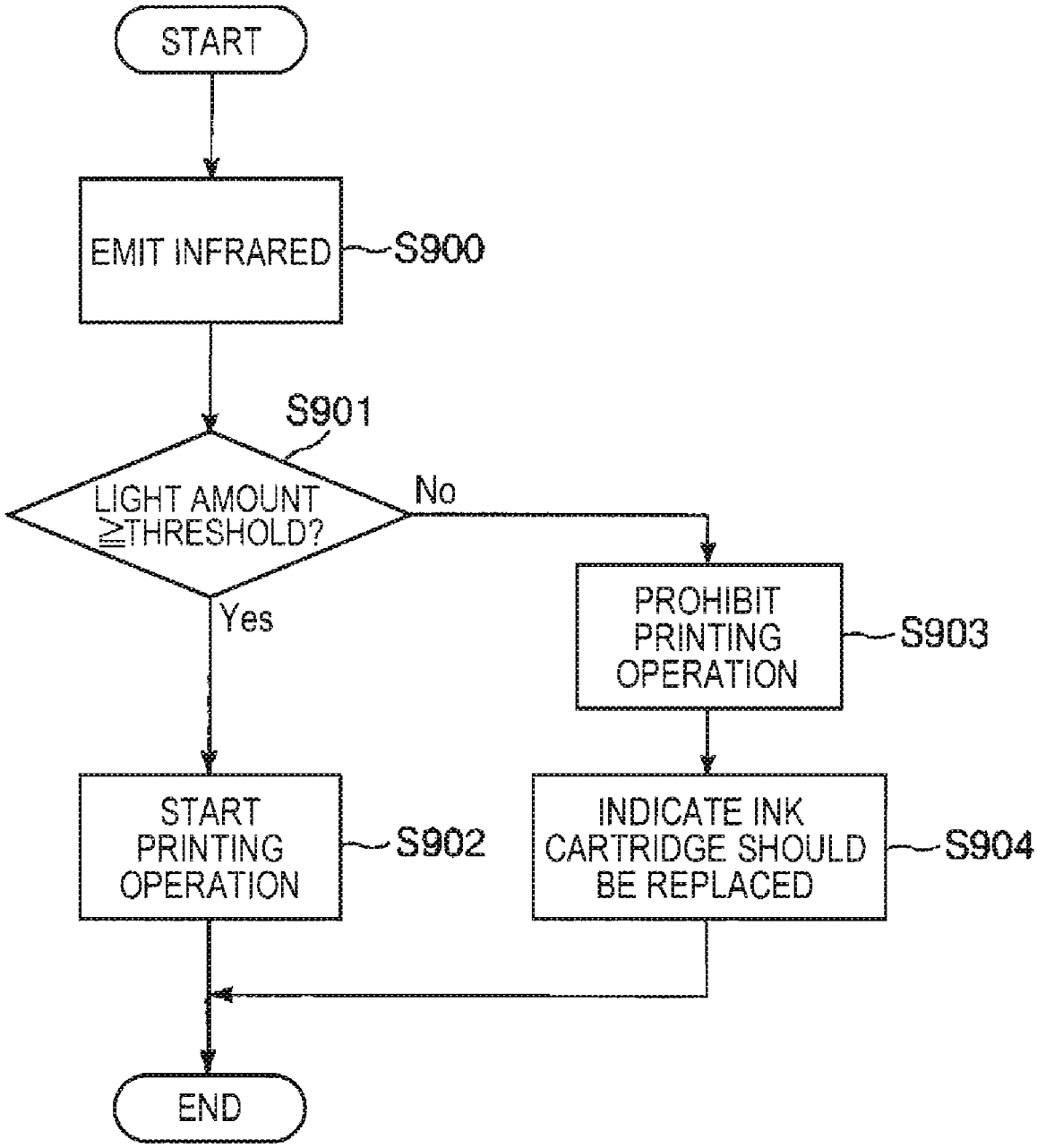
FIG. 8 is a flow chart showing a control program performed by a controller included in the printer shown in FIG. 1.

FIG. 1 is an oblique perspective view showing a printer according to a first embodiment of the invention. FIGS. 2A and 2B are oblique perspective views showing an ink cartridge according to the first embodiment of the invention to be loaded into the printer shown in FIG. 1. FIG. 3 is a sectional view taken along line A-A of FIG. 2A. FIGS. 4A and 4B are oblique perspective views showing a terminal included in the ink cartridge shown in FIGS. 2A and 2B. FIG. 5 is an oblique perspective view showing a droplet discharging head included in the printer shown in FIG. 1. FIG. 6 is a side view of the droplet discharging head shown in FIG. 5. FIG. 7 is a plan view of the droplet discharging head shown in FIG. 5. FIG. 8 is a flow chart showing a control program performed by a controller included in the printer shown in FIG. 1. Hereafter, the upper sides of FIG. 1, FIG. 2A, and FIGS. 3 to 6 (same in FIGS. 9 and 10) are referred to as "upper," and their lower sides as "lower" for convenience. Similarly, the left sides of the FIG. 1, FIG. 2B, FIG. 3, and FIG. 7 will be referred to as "left," and their right sides as "right."

A printer 100 shown in FIG. 1 prints on a recording medium 109 (e.g., paper surface) with an ink cartridge 1 loaded. First, the ink cartridge 1 will be described. The ink cartridge 1 shown in FIGS. 2A and 2B includes a cartridge body 2, a sensor 8 disposed on the cartridge body 2, and a circuit substrate (electrode) 6 electrically coupled to the sensor 8.

The cartridge body 2 has a rectangular outer shape. The cartridge body 2 has a hollow that serves as an ink supply system 7 for supplying ink to a printer 100 with the cartridge loaded. The ink supply system 7 includes a reservoir 71 in which ink is reserved, an outlet 72 through which ink is supplied to the printer 100 with the cartridge loaded, and a channel 73 for leading ink from the reservoir 71 to the outlet 72.

The color of the ink that fills the ink supply system 7 is not limited to a particular one; colors include red, blue, yellow, and black. This ink is ink to which an infrared absorbing material for absorbing infrared radiation L is added, in order to distinguish the ink from other types of ink having an identical color. In other words, the ink has higher absorptivity than other types of ink having an identical color. The infrared absorbing material is not limited to a particular one; infrared absorbing materials include coloring matters, such as a phthalocyanine coloring matter, a naphthalocyanine coloring matter, an anthraquinone coloring matter, an indolenine coloring matter, a polymethine coloring matter, a squarylium coloring matter, a cyanine dye, a nitroso compound and a metal complex thereof, azo-cobalt salt, thiol nickel salt, a triarylmethane coloring matter, an immonium coloring matter, a naphthoquinone coloring matter, an anthraquinone dye, an anthracene coloring matter, an azulene coloring matter, a phthalide coloring matter, and inorganic oxides, such as ITO (tin-doped antimony oxide) and ATO (antimony-doped tin oxide). Since the infrared absorbing material is principally made of such a material, the infrared radiation L can surely be absorbed.

The cartridge body 2 is made of a substantially transparent (light-transmissive) resin material. Such a resin material is not limited to a particular one. Resin materials include a polymethyl methacrylate resin (PMMA), a polycarbonate resin, and an acrylic resin.

As shown in FIGS. 2A and 3, the reservoir 71 includes first space 711 and second space 712 communicating with the first space 711. The first space 711 has an approximately rectangular (or square) shape when seen from a side (when seen in the arrow B direction in FIG. 2A). The second space 712 is located below the first space 711, having a smaller rectangular shape than the first space 711 when seen from a side.

As shown in FIG. 3, a bottom 713 of the reservoir 71 communicates with a channel 73. The channel 73 takes the shape of a crank that is bent at its several points (three points in this embodiment). Specifically, with the cartridge loaded, the channel 73 includes a first horizontal path 731 extending approximately horizontally (toward the right side of FIG. 3) from the bottom 713 of the reservoir 71, a first vertical path 732 extending approximately vertically upward (toward the upper side of FIG. 3) from a right end 731*a* of the first horizontal path 731, a second horizontal path 733 extending approximately horizontally (toward the right side of FIG. 3) from an upper end 732*a* of the first vertical path 732, and a second vertical path 734 extending approximately vertically downward (toward the lower side of FIG. 3) from a right end 733*a* of the second horizontal path 733 and reaching the outlet 72.

Such a shape taken by the channel 73 has the following advantage: When the printer 100 is placed in a position slightly inclined relative to the horizontal direction and used with the cartridge loaded, the ink can surely be led from the reservoir 71 to the outlet 72 even though the remaining amount of the ink inside the ink cartridge 1 (ink supply system 7) decreases. Thus, the ink inside the ink cartridge 1 can be exhausted.

In the structure shown in FIG. 2A, the ink cartridge 1 includes one ink supply system 7. However, the number of the ink supply systems is not limited to one; two or more ink supply systems may be formed. If the ink cartridge 1 includes three ink supply systems 7, the ink supply systems may be filled with red ink, blue ink, and yellow ink, respectively.

Formed on the right side of the bottom 21 of the cartridge body 2 is a projection 22 that projects downward (see FIG. 2B). The projection 22 has a recess 221, and the recess 221 has the outlet 72 (that opens downward).

The ink cartridge 1 is provided with a valve mechanism 23 for opening/closing the outlet 72. The valve mechanism 23 includes a valve body 231, a sealing material 2335, and a coil spring 232 for urging the valve body 231 downward (toward the sealing material 233).

The sealing material 233 is disposed in the form of a ring along the inner surface of the recess 221. The sealing material 233 is made of an elastic material. The elastic material is not limited to a particular one. For example, various kinds of rubber material, such as natural rubber, isoprene rubber, butadiene rubber, styrene-butadiene rubber, nitrile rubber, chloroprene rubber, butyl rubber, acrylic rubber, ethylene-propylene rubber, hydrin rubber, urethane rubber, silicone rubber, and fluoro rubbers can be used.

The valve body 231 is disposed so as to be movable inside the second vertical path 734 of the channel 73 along the longitudinal direction of the second vertical path 734. The valve body 231 includes a disc 231*a* and a guide 231*b* integrally formed on the upper surface of the disc 231*a*. The lower surface of disc 231*a* comes into close contact with the sealing material 233 by the urging force of the coil spring 232 with the ink cartridge 1 not loaded into the printer 100. This prevents the ink frown unwillingly flowing out from the outlet 72. The guide 231*b* slides on the inner surface of the second vertical path 734. This allows the valve body 231 to stably move inside the second vertical path 734 along the longitudinal direction of the second vertical path 734. The material for the valve body 231 is not limited to a particular one. As such a material, for example, one of various types of metal material and plastic or a combination thereof can be used.

With the cartridge loaded, a midair needle 36 disposed on the droplet discharging head 101 included in the printer 100 presses the valve body 2-31 (disc 231*a*) against the urging force of the coil spring 232 to opens the outlet 72. Thus, the ink is supplied to the droplet discharging head 101 via an aperture 361 formed on the outer surface of the upper end of the midair needle 36.

A plate-shaped engaging piece 24 is disposed on the upper part of the edge 25 of the cartridge body 2. The lower end of the engaging piece 24 is rotatably supported by the edge 25 of the cartridge body 2 (see FIG. 2B). The engaging piece 24 has a first projection 241 formed on a surface thereof and two second projections formed on edges thereof.

As shown in FIG. 6, when the ink cartridge 1 is loaded, the first projection 241 of the engaging piece 24 engages with a first recess 38 formed on a carriage 107 for detachably loading the ink cartridge 1 into the printer 100 (droplet discharging head 101). The second projections 242 each engage with a second recess 37 formed on the carriage 107. Such engagement prevents the ink cartridge 1 from unwillingly becoming unloaded from the carriage 107.

Formed below the edge 25, of the cartridge body 2 is a guide 27 projecting in the form of a plate. When the ink cartridge 1 is loaded, the guide 27 engages with a third recess (guide groove) 39 that is formed on the carriage 107 for guiding the guide 27. Thus, the ink cartridge 1 is positioned.

Formed above an edge 26 opposite to the edge 25 of the cartridge body 2 is a recess 28. The recess 28 is formed in a size such that the flat part of a thumb can be put into the recess. Formed below an edge 26 of the cartridge body 2 so as to project from the cartridge body 2 is a substrate disposing section 29 on which a substrate 6 is disposed. As shown in FIG. 6, when the ink cartridge 1 is loaded, an upper surface 291 of the substrate disposing section 29 engages with (is pressed by) an engaging pin 4-0 that is provided on the carriage 107 and made of an elastic material. Loading the ink cartridge 1 in such a manner prevents the ink cartridge 1 from unwillingly becoming unloaded from the carriage 107. Moreover, the ink cartridge 1 is surely positioned relative to the carriage 107.

As shown in FIG. 4A, the substrate 6 disposed on the substrate disposing section 29 includes a substrate body 61 and a plurality of terminals (ink cartridge terminals) 62 disposed on the substrate body 61. The substrate body 61 is made of an approximately square plate-shaped material.

As shown in FIG. 4A, the terminals 62 are disposed in the form of a hound's tooth on a surface of the substrate body 61. When the ink cartridge 1 is loaded, the terminals 62 come into contact with terminals (carriage terminal) 41 disposed on the carriage 107 included in the printer 100 (see FIG. 6). Thus, with the ink cartridge 1 loaded, it is possible to transmit a signal from the sensor 8 to the printer 100 ads well as to transmit a signal (instruction) from the printer 100 to the sensor 8. As shown in FIG. 4B, the terminals 62 are collected by a terminal collecting section 63 on the back of the substrate body 61 and electrically coupled to the sensor 8 via a conductor (cable (not shown)) coupled to the terminal collecting section 63.

The method for forming the terminals 62 on the substrate body 61 is not limited to a particular one. Such methods include printing. Using printing allows the terminus 62 to be formed with high accuracy. Thus, when the ink cartridge is loaded, the terminals 62 surely come into contact with the terminals 41 of the carriage 107.

As shown in FIG. 3, in the ink supply system 7, the second horizontal path 733 of the channel 73 is previously filled with gas with the ink cartridge 1 yet to be used. As gas that fills the second horizontal path 733 (channel 73), air is used in this embodiment.

As shown in FIGS. 2A and 3, the cartridge body 2 includes the sensor 8. The sensor 8 includes a light emitter 81 for emitting infrared radiation L and a light receiver for receiving the infrared radiation L emitted from the light emitter 81. The light emitter 81 and light receiver 82 are disposed so as to be opposed to each other with the second horizontal path 733 therebetween in the longitudinal direction of the second horizontal path 733.

Such disposition makes the second horizontal path 733 a detection region to be subjected to detection by the sensor 8. More specifically, the sensor 8*s* detects whether the detection region, that is, the second horizontal path 733 is filled with ink or gas (air).

Disposing the light emitter 81 and light receiver 82 so as to be opposed to each other in the longitudinal direction of the second horizontal path 733 allows the infrared radiation L to be surely emitted from the light emitter 81 toward the second horizontal path 733 (ink supply system 7). The infrared radiation L emitted from the light emitter 81 is transmitted through the second horizontal path 733 along the longitudinal direction of the second horizontal path 733 and surely received by the light receiver 82. Thus, the sensor 8 serves as a transmission type sensor.

Since the infrared radiation L is surely emitted and received as described above, if ink is present in the second horizontal path 733 with the ink cartridge 1 yet to be used, the infrared radiation L is surely absorbed by the infrared absorbing material mixed into the ink, whereby the amount of the infrared radiation L received by the light receiver 82 is surely reduced. If ink is not present in the second horizontal path 733, that is, the second horizontal path 733 is filed with air with the ink cartridge 1 yet to be used, the amount of the infrared radiation L received by the light receiver 82 is approximately equal to that of the infrared radiation L emitted by the light emitter 81.

In the ink cartridge 1 having these features, whether or not the use of the ink cartridge 1 is proper is determined based on information from the sensor 8, that is, based on the amount of the infrared radiation L with the ink cartridge 1 yet to be used. Whether or not the use of the ink cartridge 1 is proper will be described later.

Disposing the sensor 8 as described above causes the infrared radiation L to go along the longitudinal direction of the second horizontal path 733 between the light emitter 81 and the light receiver 82. Therefore, if ink is present in the second horizontal path 733 with the ink cartridge 1 yet to be used, the infrared radiation L is surely absorbed by the infrared absorbing material mixed into the ink, whereby the amount of the infrared radiation L received by the light receiver 82 is surely reduced. If the second horizontal path 733 is filled with air with the ink cartridge 1 yet to be used, the amount of the infrared radiation L received by the light receiver 82 is surely approximately equal to that of the infrared radiation L emitted by the light emitter 81.

With the ink cartridge 1 yet to be used, there occurs (is formed) an interface (liquid surface) P between ink and air in the ink supply system 7. In the structure shown in FIG. 3, the interface P is located between both ends of the first horizontal path 731. Such a state is maintained by the surface tension of the interface P. The shape and size of the first horizontal path 731 is set up so that even though a vibration or shock is given to the ink cartridge 1, the surface tension is maintained and no bubbles (air) enter the reservoir 71.

The peak wavelength of the infrared radiation L emitted by the light emitter 81 is preferably 750 to 1500 nm, more preferably, 800 to 1300 nm. This allows the infrared radiation L to be surely absorbed by the infrared absorbing material mixed into the ink.

Now the printer 100 will be described.

As shown in FIG. 1, the printer 100 includes the droplet discharging head 101 below the carriage 107. The droplet discharging head 101 is moved in the arrow direction (longitudinal direction of the guide shaft 102) by a carriage motor 104 via a belt 103 while guided by the guide shaft 102. The droplet discharging head 101 discharges ink supplied from the ink cartridge 1 loaded into the carriage 107 in the form of droplets.

In the printer 100 having these features, a recording medium 109 is conveyed by a paper feed roller (not shown) and a paper hold roller (not shown) so as to pass below the droplet discharging head 101. At this time, the recording medium 109 is subjected to printing using ink droplets ejected from the droplet discharging head 101 and discharged from the printer 100 by a discharge roller (not shown).

As shown in FIGS. 5 and 7, the carriage 107 can be loaded with four ink cartridges 1. The ink cartridges 1 are filled with red ink, blue ink, yellow ink, and black ink, respectively, sequentially from the right side of FIG. 7.

The carriage 107 has grooves 31 and 32 on the back thereof (on the right side of FIG. 6). The grooves 31 and 32 are formed along the direction in which the four ink cartridges 1 are disposed. Inserted into the groove 31 is a guide shaft 102. Inserted into the groove 32 is a guide (not shown) formed so as to protrude in parallel to the guide shaft 102 in the vicinity of the guide shaft 102. This allows the carriage 107 to surely slide (move) along the guide shaft 102 and the abovementioned guide. Therefore, it is possible to stably print on the recording medium 109 using the droplet discharging head 101.

The carriage 107 includes a plurality of ribs 33 and ribs 34 formed so as to protrude for partitioning the adjacent ink cartridges 1. The ribs 33 partition the sides of the ink cartridges 1 where the engaging pieces 24 are disposed. The ribs 34 partition the sides of the ink cartridges 1 where the substrate disposing sections 29 are disposed.

Disposing the ribs 33 and ribs 34 in this manner causes both sides of the ink cartridges 1 to be guided by the ribs 33 and ribs 34, facilitating operations of loading/unloading the ink cartridges 1.

As shown in FIG. 3, the printer 100 includes a controller 105 electrically coupled to the terminals 41 of the carriage 107. The controller 105 includes a central processing unit (CPU) and a storage unit. The storage unit includes a storage medium (recording medium) for storing (recording) a program, data, or the like that is readable by the CPU. This storage unit includes a magnetic or optical medium or a semiconductor memory, such as a random access memory (RAM; volatile or nonvolatile), a Floppy disc (FD; "Floppy" is a trademark), a hard disk (HD), or a compact disc read-only memory (CD-ROM). The controller 105 having these features serves to control printing operations, this is, droplet discharging operations of the droplet discharging head 101.

The printer 100 includes a display (notifying unit) 106 for indicating (notifying) that the ink cartridge 1 should be replaced (or information related to cartridge replacement). The display 106 may include, for example, a liquid crystal panel.

In the printer 100 having these features, when an ink cartridge 1 whose second horizontal path 733 is filled with air with the ink cartridge 1 yet to be used, that is, when a genuine ink cartridge 1 (hereinafter referred to as "genuine ink cartridge") is loaded into the carriage 107, normal printing is carried out, that is, printing is carried out onto the recording medium 109 by ejecting droplets from the droplet discharging head 101 as described above.

Such normal printing is carried out if when printing is carried out for the first time using the ink cartridge 1 (genuine ink cartridge) that is yet to be used, the controller 105 determines whether the use of the ink cartridge 1 is proper or not, that is, whether the channel 73 is filled with ink or air, based on information from the sensor 8 included in the ink cartridge 1 and, as a result, determines that the channel 73 is filled with air (use of the ink cartridge 1 is proper).

If normal printing is carried out, ink is consumed with time and finally reduced up to the remaining amount (for example, approximately zero) such that normal printing can no longer be carried out. In other words, ink runs out. In this case, if the used (empty) ink cartridge 1 is replaced with a virgin ink cartridge 1 described above, normal printing is carried out again.

However, it is conceivable, for example, to subsequently fill (inject) the used ink cartridge 1 with ink mixed with an infrared absorbing material or ink mixed with no such material via the outlet 72 with a malicious intent. In the ink cartridge 1 (hereinafter referred to as "fraudulent ink cartridge") filled with fraudulent ink in this manner, the outlet 72 through the reservoir 71, that is, the almost entire ink supply system 7 is filled with the ink. Consequently, the channel 73 is also filled with the ink.

If an fraudulent ink cartridge is loaded as a virgin ink cartridge 1 into the carriage 107 and printing is carried out for the first time using the fraudulent ink cartridge, the controller 106 included in the printer 100 determines that the second horizontal path 733 is filled with ink, that is, determines that the use of the ink cartridge is not proper. As a result, any printing operation is prohibited, whereby the ink cartridge 1 is surely prevented from being reused fraudulently.

As described above, whether the use of such an ink cartridge is proper or not is determined based on information from the sensor 8. Such information from the sensor 8 is not limited to particular information. In this embodiment, the amount of the infrared radiation L received by the light receiver 82 is used as such information.

If ink is present in a virgin ink cartridge 1 (second horizontal path 733), the infrared radiation L emitted from the light emitter 81 is surely absorbed by the infrared absorbing material mixed into the ink whereby the amount of the infrared radiation L received by the light receiver 82 becomes less than the amount of the infrared radiation L emitted from the light emitter 81.

If air is present in a virgin ink cartridge 1 (second horizontal path 733), the infrared radiation L emitted from the light emitter 81 is not absorbed as described above. As a result, the amount of the infrared radiation L received by the light receiver 82 is approximately equal to that of the infrared radiation L emitted from the light emitter 81.

Now the program performed by the controller 105 included in the printer 100 will be described referring to the flowchart in FIG. 8.

When the printer 100 loaded with a virgin genuine ink cartridge attempts to carry out a printing operation using the ink cartridge for the first time, the light emitter 81 emits the infrared radiation L (step S900).

Then it is determined whether or not the amount of the infrared radiation L received by the light receiver 82 is equal to or more than the threshold (predetermined value) previously stored (set up) in the storage unit included in the controller 105 (step S901). If it is determined that the amount is not less than the threshold, that is, the amount is equal to or more than the threshold (the loaded ink cartridge is a genuine cartridge and suitable for printing (use)), the printing operation (normal printing) is carried out (step S902).

If a fraudulent ink cartridge is loaded, it is determined in step S901 that the amount of the infrared radiation L is less than the threshold (the loaded ink cartridge is a fraudulent ink cartridge and not suitable for printing (use)). As a result, any printing operation is prohibited at the printer 100 (step S903).

Then the display 106 indicates that the ink cartridge should be replaced (with a genuine ink cartridge) (step S904).

These features prevent a used ink cartridge from being used reused a third party, that is, being reused fraudulently, due to injection of a fraudulent ink into the used ink cartridge.

Methods for prohibiting any printing operation include prohibiting of any droplet discharging operation of the droplet discharging head 101 and prohibiting of any conveying operation (paper feed operation) for conveying the recording medium 109.

When normal printing is started, the amount of the infrared radiation L temporarily becomes less than the threshold. In such normal printing, ink is consumed with time and finally is exhausted in the second horizontal path 733. That is, the infrared radiation L is no longer absorbed by the infrared absorbing material. At this time, the amount of the infrared radiation L received by the light receiver 82 reaches the threshold. Then the number of ejected ink droplets (number of print dots) is counted. When the counted number of ejected droplets reaches the number of possibly ejected ink droplets (predetermined number of dots) calculated from the amount (volume) of the genuine ink remaining in the ink cartridge 1 and a volume per ink droplet such that the remaining amount of the genuine ink becomes approximately zero, the printing operation is stopped. These features allow the ink to be surely exhausted. Note that the number of possibly ejected droplets is previously stored in the storage unit included in the controller 105.

When the printing operation is stopped (prohibited), the display 106 may indicate that the ink cartridge should be replaced (with a genuine cartridge), as described above. This makes it possible to recognize the replacement timing of the ink cartridge 1.

The controller 105 performs control such that when a loaded genuine ink cartridge is unloaded from and reloaded into the carriage 107 before the loaded genuine cartridge becomes empty, a printing operation can be carried out again. This allows normal printing to be carried out even though the genuine ink cartridge in use is unloaded and then reloaded.

The conditions such as the infrared absorbing material content or the ingredients thereof may be changed according to the production date of the ink cartridge 1 or the peak wavelength of the infrared radiation L emitted from the light emitter 81 may be changed. Thus, the production date (production history) of the ink cartridge 1 can be managed.

Second Embodiment

Figure 9:
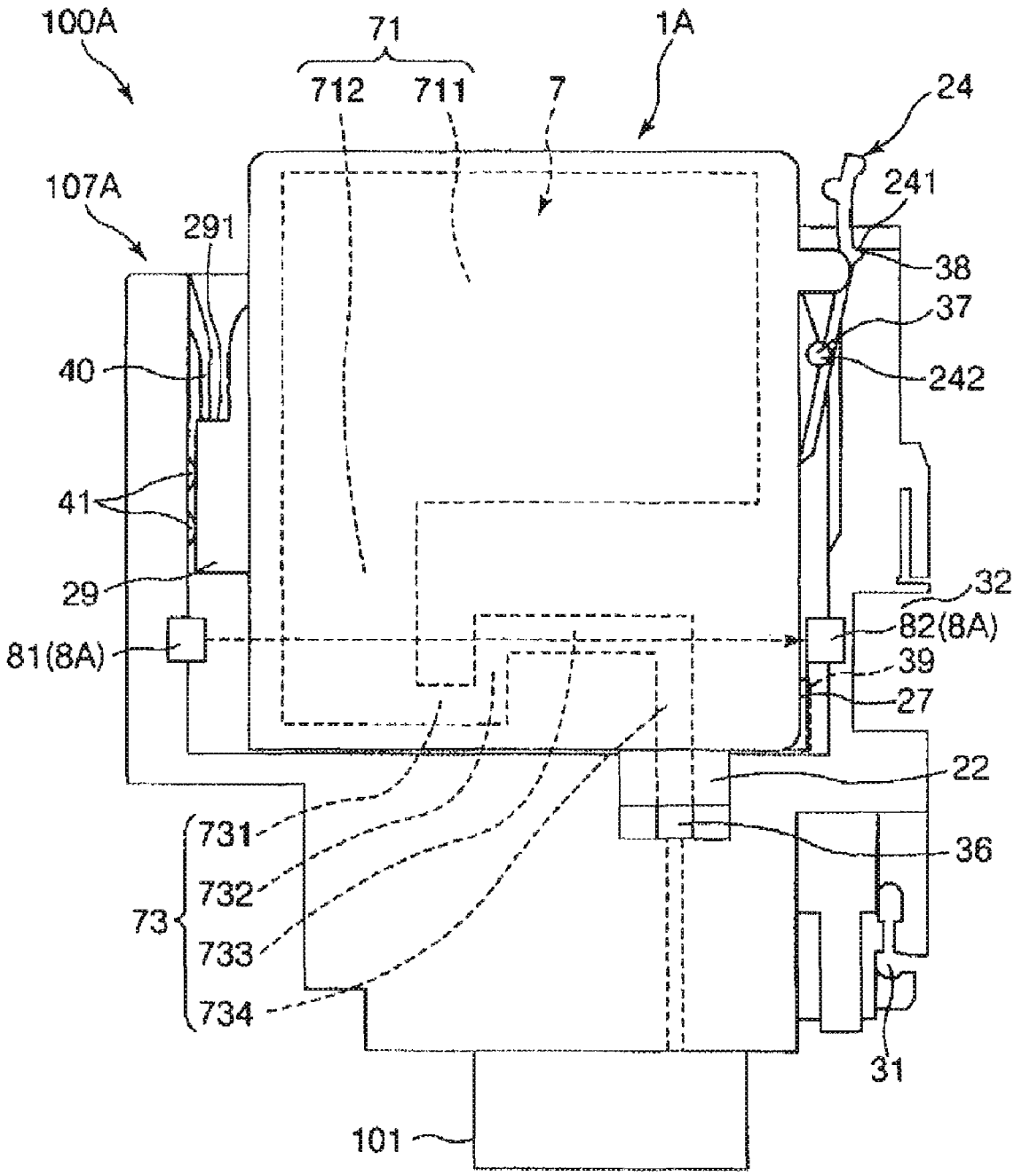
FIG. 9 is a side view of a droplet discharging head according to a second embodiment of the invention.

FIG. 9 is a side view of a droplet discharging head according to a second embodiment of the invention. A printer according to the second embodiment of the invention will be described below referring to this drawing. Description will be made principally on the difference between the first and second embodiments; no description will be made on similar characteristics. This embodiment is similar to the first embodiment except that the sensor is disposed on the printer.

As shown in FIG. 9, a carriage 107A included in the printer 100A includes a sensor 8A having approximately similar features to the sensor 8 included in the ink cartridge 1 according to the first embodiment. An ink cartridge 1A to be loaded into the carriage 107A is approximately similar to the ink cartridge 1 according to the first embodiment except that the sensor 8 described in the first embodiment is omitted.

The sensor 8A includes the light emitter 81 disposed adjacent to the terminal 41 (on the left side of FIG. 9) of the carriage 107A and the light receiver 82 disposed adjacent to the third recess 39 (on the right side of FIG. 9) of the carriage 107A so as to be opposed to the light emitter 81. The light emitter 81 and light receiver 82 are electrically coupled to the controller 105 included in the printer 100.

The second horizontal path 733 of the ink supply system 7 (channel 73) of the ink cartridge 1A is located between the light emitter 81 and light receiver 82 with the ink cartridge loaded. Thus, the light path between the light emitter 81 and light receiver 82 is along the longitudinal direction of the second horizontal path 733. Therefore, if ink is present in the second horizontal path 733, the infrared radiation L is surely absorbed by the infrared absorbing material mixed into the ink, whereby the amount of the infrared radiation L received by the light receiver 82 is surely reduced. If ink is not present in the second horizontal path 733, the amount of the infrared radiation L received by the light receiver 82 is surely approximately equal to that of the infrared radiation L emitted by the light emitter 81.

The printer 100*a* having these features performs control approximately similar to the printer 100 according to the first embodiment. This prevents a used ink cartridge from being reused by a third party, that is, being reused fraudulently, due to injection of a fraudulent ink into the used ink cartridge.

Third Embodiment

Figure 10:
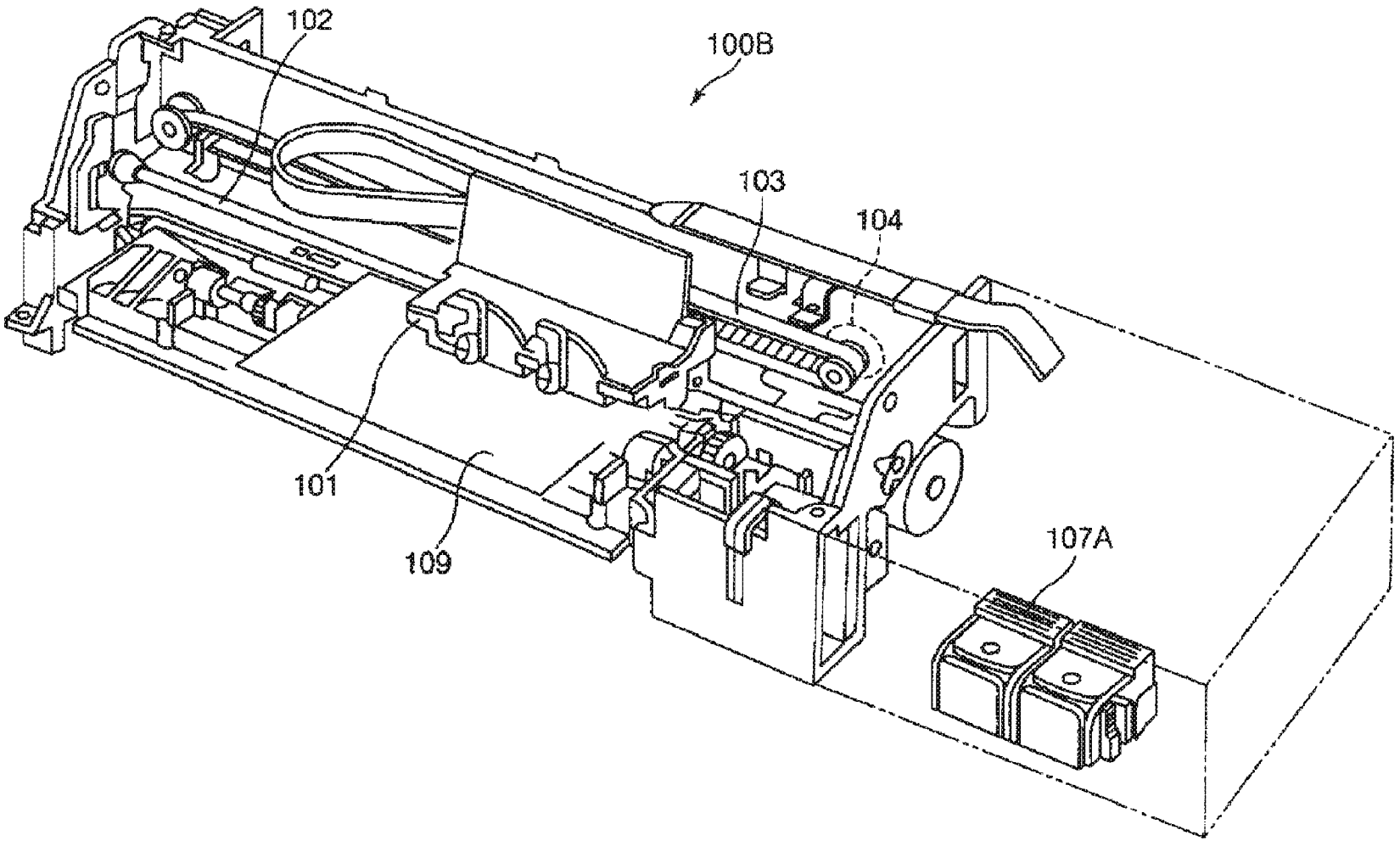
FIG. 10 is an oblique perspective view showing a printer according to a third embodiment of the invention.

FIG. 10 is an oblique perspective view showing a printer according to a third embodiment of the invention. A printer according to the third embodiment of the invention will be described below referring to this drawing. Description will be made principally on the difference between this embodiment and the first and second embodiments; no description will be made on similar characteristics. This embodiment is similar to the second embodiment except that the carriage is fixed.

In a printer 100B shown in FIG. 10, the carriage 107A is fixed. In other words, the carriage 107A does not move along the guide shaft 102. On the other hand, the droplet discharging head 101 moves along the guide shaft 102. The droplet discharging head 101 is coupled to the carriage 107A with a tube (not shown) therebetween. Thus, ink is supplied from the ink cartridge 1A loaded into the carriage 107A to the droplet discharging head 101 via the tube.

The ink cartridge and printers according to the embodiments of the invention have heretofore been described referring to the drawings. However, the invention is not limited to those embodiments and the components included in the ink cartridge and printers can be replaced with optional ones having similar functions. Moreover, optional components may be added to the ink cartridge and printers.

The invention may also be a combination of arbitrary two or more features of the ink and printers according to the embodiments. For example, the carriage described in the first embodiment may be fixed as with the carriage according to the third embodiment.

Gas to fill the channel is not limited to air and may be, for example, inert gas such as nitrogen. If inert gas is used as gas to fill the channel, for example, virgin ink is prevented from oxidation.

The sensor is not limited to a transmission type one and may be of reflection type. There occurs a difference in reflectivity on the wall surface of the second horizontal path between when the second horizontal path is filled with gas and when it is filled with ink. A reflection type sensor uses such a reflectivity difference.

What is claimed is:

1. An ink cartridge that is filled with ink and is loaded into a printer, the ink cartridge comprising:

a reservoir reserving the ink;

an outlet through which the ink is supplied to the printer with the ink cartridge loaded;

at least one ink supply system including a channel, the channel leading the ink from the reservoir to the outlet; and a sensor detecting whether the channel is filled with the ink or gas;

an ink cartridge terminal electrically coupled to the sensor, the ink cartridge terminal making contact with a printer terminal upon loading of the ink cartridge, the printer terminal being disposed on the printer, wherein a detection region of the channel, where detection is carried out by the sensor, is previously filled with gas with the ink cartridge yet to be used; and whether or not the use of the ink cartridge is proper is determined based on information from the sensor.

2. The ink cartridge according to claim 1, wherein the sensor includes:

a light emitter emitting light toward the channel; and a light receiver disposed so as to be opposed to the light emitter with the channel therebetween, the light receiver receiving light emitted from the light emitter and transmitted through or reflected from the channel.

3. The ink cartridge according to claim 2, wherein a light path between the light emitter and light receiver is along a longitudinal direction of the channel.

4. The ink cartridge according to claim 2, wherein:

the ink is infrared absorbing material-added ink in order to be distinguished from other types of ink having an identical color; and the light emitted by the light emitter is infrared radiation.

5. The ink cartridge according to claim 4, wherein a peak wavelength of infrared radiation emitted by the light emitter is 750 to 1500 nm.

6. The ink cartridge according to claim 4, wherein the infrared absorbing material is made principally of at least one of a phthalocyanine coloring matter, a naphthalocyanine coloring matter, and an anthraquinone coloring matter.

7. The ink cartridge according to claim 1, wherein the channel is bent at at least one point between both ends of the channel.

8. The ink cartridge according to claim 1, wherein:

the outlet opens downward with the ink cartridge loaded; and the channel includes:

a first horizontal path extending approximately horizontally from a bottom of the reservoir;

a first vertical path extending approximately vertically upward from an end of the first horizontal path;

a second horizontal path extending approximately horizontally from an upper end of the first vertical path; and a second vertical path extending approximately vertically downward from an end of the second horizontal path and reaching the outlet.

9. The ink cartridge according to claim 8, wherein the detection region is the second horizontal path.

10. The ink cartridge according to claim 1, wherein the gas with which the channel is filled is air.

11. A printer that carries out printing with the ink cartridge according to claim 1 loaded, the printer comprising:

a carriage into which the ink cartridge is loaded, the carriage including a printer terminal, the printer terminal making contact with a terminal of the ink cartridge upon loading of the ink cartridge, a droplet discharging head ejecting as a droplet ink supplied from the loaded ink cartridge; and a controller electrically coupled to the printer terminal, the controller controlling a droplet discharging operation of the droplet discharging head, wherein if printing is carried out for a first time using the ink cartridge that is yet to be used, the controller determines whether the channel is filled with the ink or gas based on information from the sensor included in the ink cartridge, and if the channel is filled with the ink, the controller prohibits a printing operation.

12. The printer according to claim 11, wherein the sensor includes:

a light emitter emitting light toward the channel; and a light receiver disposed so as to be opposed to the light emitter with the channel therebetween, the light receiver receiving light emitted from the light emitter and transmitted through or reflected from the channel.

13. The printer according to claim 12, wherein the controller determines whether the channel is filled with the ink or gas according to an amount of infrared radiation received by the light receiver.

14. The printer according to claim 13, wherein the controller performs control such that if the amount is less than a predetermined value, the printing operation is prohibited.

15. The printer according to claim 13, wherein the controller performs control such that if the amount is equal to or more than a predetermined value, the printing operation is carried out.

16. The printer according to claim 15, wherein the controller performs control such that if the ink cartridge is unloaded from and then loaded into the carriage before the loaded ink cartridge becomes empty, the printing operation is carried out again.

17. The printer according to claim 15, wherein if the amount reaches the predetermined value, the controller counts a number of print dots.

18. The printer according to claim 15, wherein if the counted print dots reaches a predetermined number of dots, the controller performs control such that the printing operation is stopped.

19. The printer according to claim 11, further comprising:

a display indicating that the ink cartridge should be replaced, if the printing operation is prohibited.

20. The printer according to claim 12, wherein:

the ink is infrared absorbing material-added ink in order to be distinguished from other types of ink having an identical color; and the light emitted by the light emitter is infrared radiation.

21. The printer according to claim 20, wherein a peak wavelength of infrared radiation emitted by the light emitter is 750 to 1500 nm.

22. The printer according to claim 20, wherein the infrared absorbing material is made principally of at least one of a phthalocyanine coloring matter, a naphthalocyanine coloring matter, and an anthraquinone coloring matter.

23. A printer that carries out printing with an ink cartridge loaded, the ink cartridge being filled with ink and including a channel through which the ink passes, the channel being previously filled with gas with the ink cartridge yet to be used, the printer comprising:

a carriage into which the ink cartridge is loaded, the carriage including a printer terminal, the printer terminal making contact with a terminal of the ink cartridge upon loading of the ink cartridge, a sensor detecting whether the channel is filled with the ink or gas with the ink cartridge loaded, a droplet discharging head ejecting a droplet the ink supplied from the loaded ink cartridge; and a controller electrically coupled to the printer terminal, the controller controlling a droplet discharging operation of the droplet discharging head, wherein if printing is carried out for a first time using the ink cartridge that is yet to be used, the controller determines whether the channel is filled with the ink or gas based on information from the sensor included in the ink cartridge, and if the channel is filled with the ink, the controller prohibits a printing operation.

* * * * *